US009685149B2

(12) United States Patent
Quittner

(10) Patent No.: US 9,685,149 B2
(45) Date of Patent: Jun. 20, 2017

(54) ACOUSTIC-ELECTRONIC MUSIC MACHINE

(71) Applicant: Katherine Quittner, Aventura, FL (US)

(72) Inventor: Katherine Quittner, Aventura, FL (US)

( * ) Notice: Subject to any disclaimer, the term of this patent is extended or adjusted under 35 U.S.C. 154(b) by 0 days.

(21) Appl. No.: 15/338,836

(22) Filed: Oct. 31, 2016

(65) Prior Publication Data

US 2017/0125003 A1 May 4, 2017

Related U.S. Application Data

(60) Provisional application No. 62/250,084, filed on Nov. 3, 2015.

(51) Int. Cl.

| | |
|---|---|
| ***G10H 1/00*** | (2006.01) |
| ***G10H 3/18*** | (2006.01) |
| ***G10D 1/00*** | (2006.01) |
| ***G10H 1/32*** | (2006.01) |

(52) U.S. Cl.

CPC ..... *G10H 3/186* (2013.01); *G10D 1/00* (2013.01); *G10H 1/0066* (2013.01); *G10H 1/32* (2013.01); *G10H 3/185* (2013.01); *G10H 2240/031* (2013.01)

(58) Field of Classification Search

CPC ..... G10H 3/186; G10H 1/0066; G10H 1/32; G10H 3/185; G10H 2240/031; G10D 1/00

USPC ..... 84/264, 265, 600

See application file for complete search history.

(56) References Cited

U.S. PATENT DOCUMENTS

| | | | | | |
|---|---|---|---|---|---|
| 3,749,810 | A * | 7/1973 | Dow | A63J 17/00 | 84/701 |
| 4,968,877 | A * | 11/1990 | McAvinney | G10H 1/0553 | 250/221 |
| 5,017,770 | A * | 5/1991 | Sigalov | G10H 1/00 | 250/221 |
| 5,045,687 | A * | 9/1991 | Gurner | G10H 1/00 | 250/221 |
| 5,081,896 | A * | 1/1992 | Hiyoshi | G10H 1/00 | 250/221 |
| 5,369,270 | A * | 11/1994 | Gurner | G01S 17/026 | 250/221 |
| 5,414,256 | A * | 5/1995 | Gurner | A63F 13/06 | 250/221 |
| 5,589,654 | A * | 12/1996 | Konwiser | G10H 1/32 | 84/600 |
| 6,450,886 | B1 * | 9/2002 | Oishi | G06F 3/023 | 200/61.1 |
| 6,492,775 | B2 * | 12/2002 | Klotz | G10H 1/00 | 250/221 |
| 6,960,715 | B2 * | 11/2005 | Riopelle | G10H 1/00 | 84/600 |

(Continued)

*Primary Examiner* — Jeffrey Donels

(74) *Attorney, Agent, or Firm* — Procopio, Cory, Hargreaves & Savitch LLP

(57) ABSTRACT

A music machine, comprising: a platform; a plurality of arcos disposed around a perimeter of the platform, the plurality of arcos disposed in a substantially vertical orientation; a central mast disposed substantially at a center of the platform; and a hand wheel disposed on the central mast, wherein each of the plurality of arcos is strung with a musical instrument string, and wherein each musical instrument string is tuned to produce a musical tone when caused to vibrate.

19 Claims, 12 Drawing Sheets

(56) References Cited

U.S. PATENT DOCUMENTS

| | | | | |
|---|---|---|---|---|
| 8,431,811 | B2 * | 4/2013 | Riopelle | G10H 1/00 84/609 |
| 2007/0000374 | A1 * | 1/2007 | Clark | G10H 1/0008 84/724 |
| 2013/0138233 | A1 * | 5/2013 | Sandler | G06F 17/00 700/94 |

* cited by examiner

ACOUSTIC-ELECTRONIC MUSIC MACHINE

CROSS-REFERENCE TO RELATED APPLICATION(S)

This application claims the benefit of U.S. provisional application No. 62/250,084, filed Nov. 3, 2015, the disclosure of which is hereby incorporated in its entirety by reference.

BACKGROUND

Apparatuses and methods consistent with the present disclosure relate to musical instruments, and more particularly to an acoustic-electronic music machine.

SUMMARY

Apparatuses and methods for an acoustic-electronic music machine are provided.

According to various aspects there is provided a music machine. In some aspects, the music machine may include: a platform; a plurality of arcos disposed around a perimeter of the platform, the plurality of arcos disposed in a substantially vertical orientation; a central mast disposed substantially at a center of the platform; and a hand wheel disposed on the central mast. Each of the plurality of arcos is strung with a musical instrument string, and each musical instrument string is tuned to produce a musical tone when caused to vibrate.

According to various aspects there is provided an apparatus for performing musical compositions. In some aspects, the apparatus for performing musical compositions may include: a computer; a plurality of electronic musical instruments disposed on a platform; an audio interface configured to provide communication between the plurality of electronic musical instruments and the computer configured to control the plurality of electronic musical instruments; a plurality of acoustic musical instruments disposed around a perimeter of the platform. The platform may provide a surface for a user to stand and move around between the plurality of electronic musical instruments and the plurality of acoustic musical instruments disposed around the perimeter of the platform.

According to various aspects there is provided an acoustic-electronic musical instrument. In some aspects, the acoustic-electronic musical instrument may include: a plurality of arcos each having a bow-shaped portion and a musical instrument string strung across the bow-shaped portion, each musical instrument string tuned to produce a musical tone when caused to vibrate; a plurality of electronic musical instruments and sound processing equipment communicatively coupled to a computer with an audio interface unit; a plurality of audio transducers configured to capture musical tones produced the plurality of arcos; and an audio mixer unit configured to input audio signals from the plurality of electronic musical instruments, the sound processing equipment, and the audio transducers, adjust the audio signals, and output the audio signals to sound reproduction equipment.

Other features and advantages of the present disclosure should be apparent from the following description which illustrates by way of example aspects of the present inventive concept.

BRIEF DESCRIPTION OF THE DRAWINGS

The above and other aspects and features of the present inventive concept will be more apparent by describing example embodiments with reference to the accompanying drawings, in which.

DETAILED DESCRIPTION

While certain embodiments are described, these embodiments are presented by way of example only, and are not intended to limit the scope of protection. The methods and systems described herein may be embodied in a variety of other forms. Furthermore, various omissions, substitutions, and changes in the form of the example methods and systems described herein may be made without departing from the scope of protection.

Figure 1:
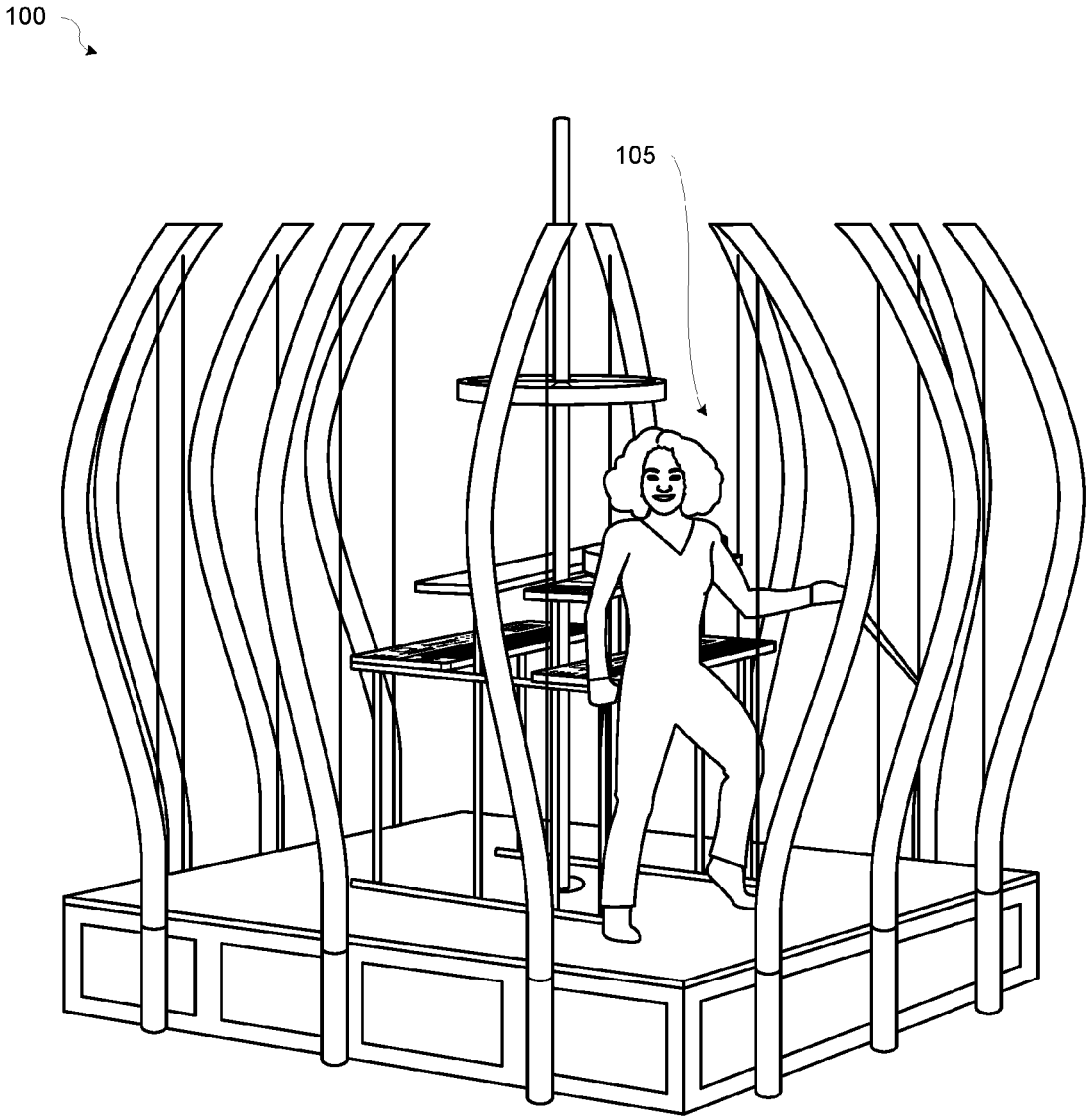
FIG. 1 is a diagram illustrating an overall view of the music machine in accordance with certain aspects of the present disclosure.

The music machine incorporates multiple and diverse elements that may be manipulated to enable a user to perform a wide variety of musical compositions. FIG. 1 is a diagram illustrating an overall view of the music machine 100 in accordance with certain aspects of the present disclosure. As may be understood from FIG. 1, a user 105 may position herself/himself on the platform of the music machine 100 and may move around on the platform to access and operate the various elements of the music machine 100.

Figure 2:
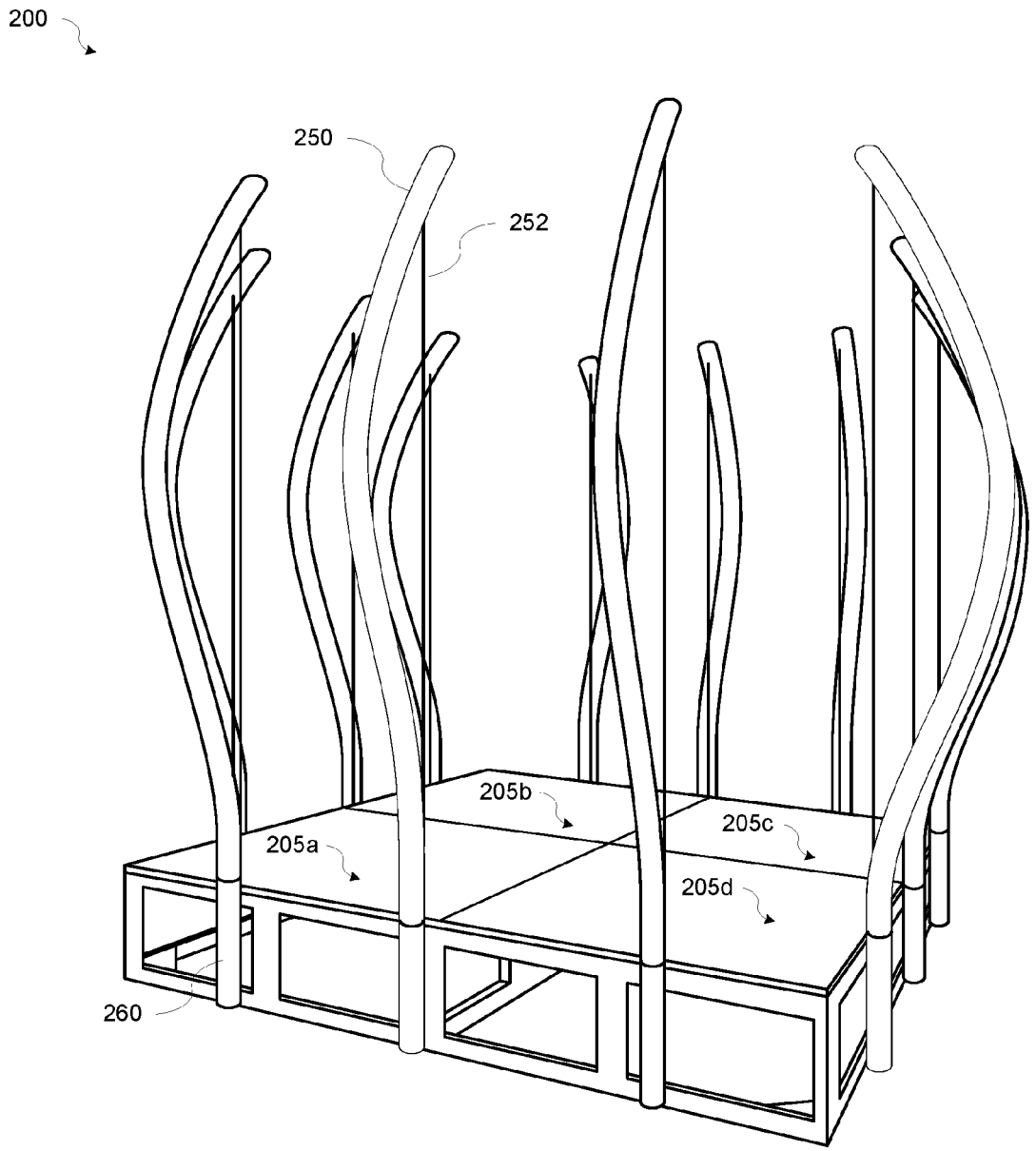
FIG. 2 is a diagram illustrating a platform of the music machine in accordance with certain aspects of the present disclosure.

FIG. 2 is a diagram illustrating a platform 200 of the music machine 100. The platform 200 may include a plurality of sub-platforms 205*a*-205*b* in accordance with certain aspects of the present disclosure. The sub-platforms 205*a*-205*b* may be removably attached to each other. When attached to each other the sub-platforms 205*a*-205*b* may be held together with clamps (not shown) from the underside of the sub-platforms 205*a*-205*b*. One of ordinary skill in the art will appreciate that other methods of attaching the sub-platforms 205*a*-205*b* to each other may be used without departing from the scope of the present disclosure. When attached to each other, the sub-platforms 205*a*-205*b* may form a platform 200 that is about 240 cm long×240 cm wide. One of ordinary skill in the art will appreciate that the dimensions of the platform 200 are exemplary and that other dimensions may be used without departing from the scope of the present disclosure.

Figure 3:
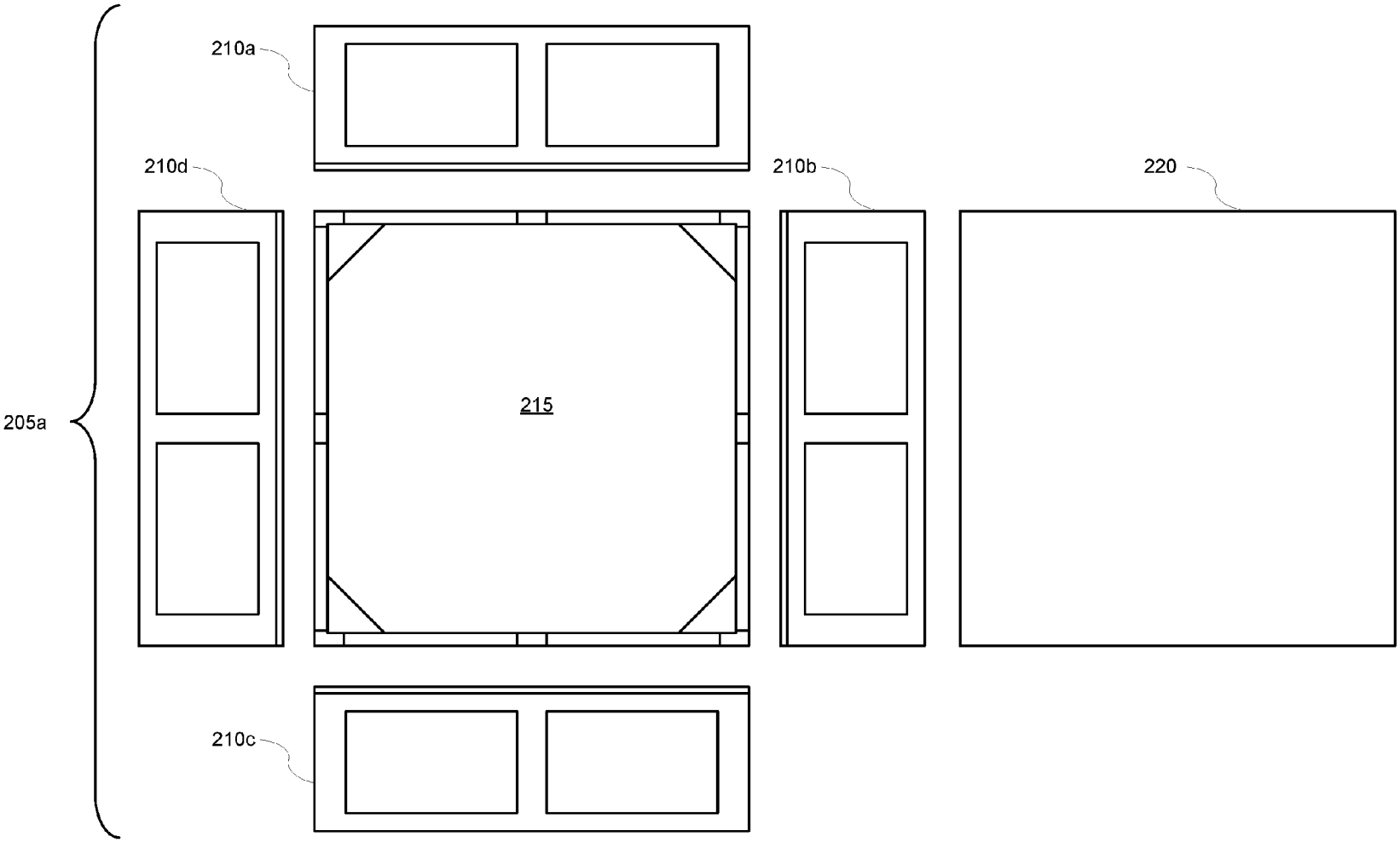
FIG. 3 is an exploded view of a sub-platforms of the music machine in accordance with certain aspects of the present disclosure.

FIG. 3 is an exploded view of a sub-platform 205*a*-205*b* of the music machine 100 in accordance with certain aspects of the present disclosure. Each of the sub-platforms 205*a*-205*b* are similar and include similar elements; therefore, only one sub-platform 205*a* will be described as an example. Referring to FIG. 3, the sub-platform 205*a* may include a plurality of frame pieces 210*a*-201*d* and a deck 220. The frame pieces 210*a*-201*d* may be attached to each other by methods known to those of skill in the art to form a frame 215. The deck 220 may be attached to the frame 215 by methods known to those of skill in the art to form the sub-platform 205*a*. The sub-platform 205*a* may also include lockable wheels (not shown) attached to the frame 215 to facilitate movement of the sub-platform 205*a*.

Each sub-platform 205*a*-205*b* may have dimensions of about 120 cm long×120 cm wide and 40 cm high. Each sub-platform 205*a*-205*b* may be supported by struts (not shown) in a manner known to those of skill in the art. One of ordinary skill in the art will appreciate that the sub-platforms 205*a*-205*b* may have different shapes (e.g., rectangle, oval, octagon, etc.), different dimensions, and/or a different numbers of sub-platforms 205*a*-205*b* may be used without departing from the scope of the present disclosure. Each sub-platform 205*a*-205*b* of the music machine 100 is light weight and may be assembled and disassembled by two people in a short amount of time (e.g., about 2 hours).

Referring again to FIG. 2, the platform 200 may form a stage on which a user may stand. A plurality of arcos 250 may be removably attached around the perimeter of the platform 200 in a substantially vertical orientation. For example, three arcos 250 may be arranged along each edge of the platform 200 for a total of twelve arcos 250, and each arco 250 may be removably attached to the platform 200 by, for example, but not limited to, a bracket 260 disposed on the perimeter of the platform 200. Each arco 250 may be removed from one bracket 260 and repositioned in another bracket 260 disposed on the perimeter of the platform 200. One of ordinary skill in the art will appreciate that more or less than twelve arcos 250 may be used and that the positions of the arcos 250 around the perimeter of the platform 200 may vary without departing from the scope of the present disclosure.

Figure 4A:
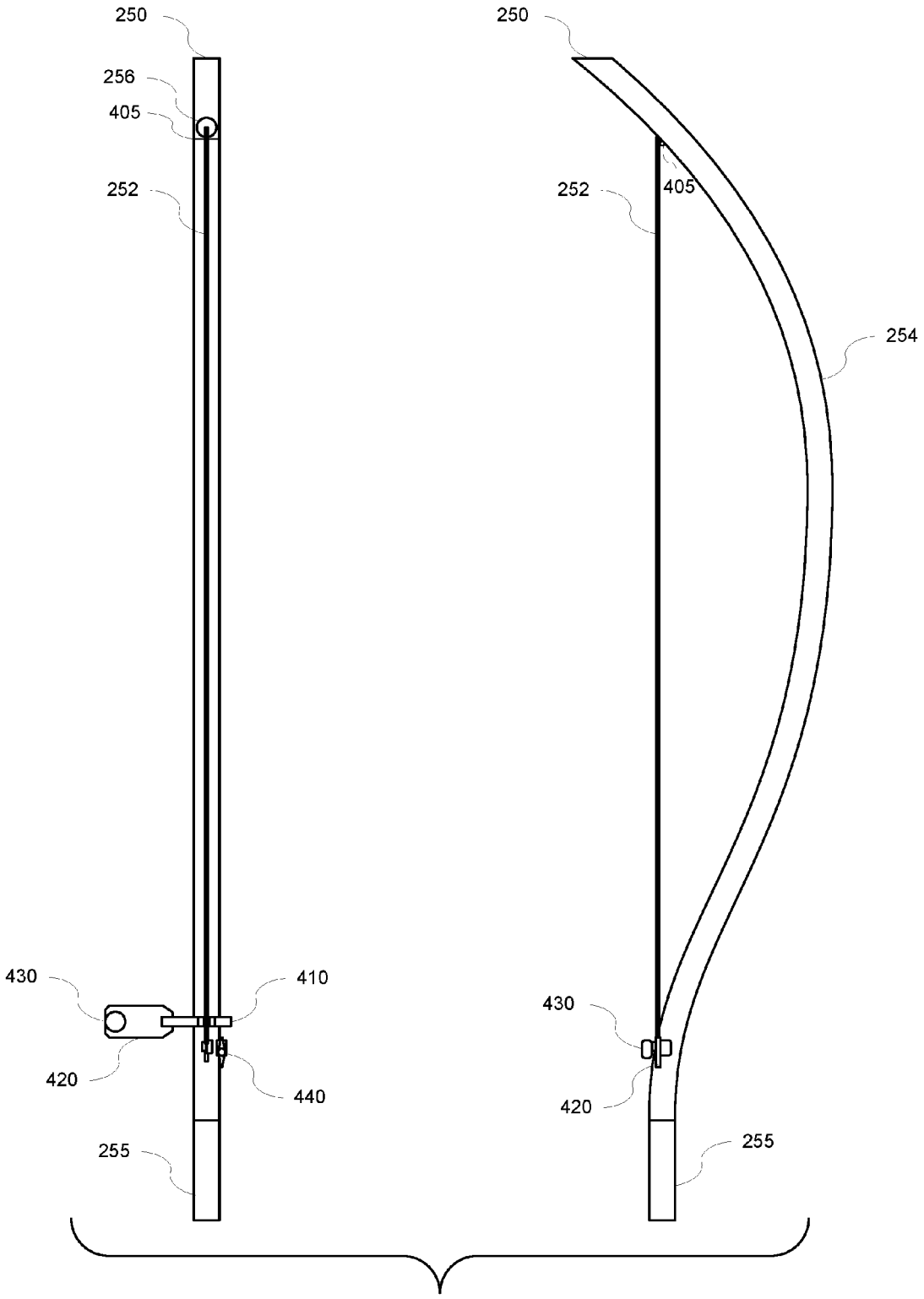
FIGS. 4A and 4B are diagrams illustrating an arco in accordance with certain aspects of the present disclosure.
Figure 4B:
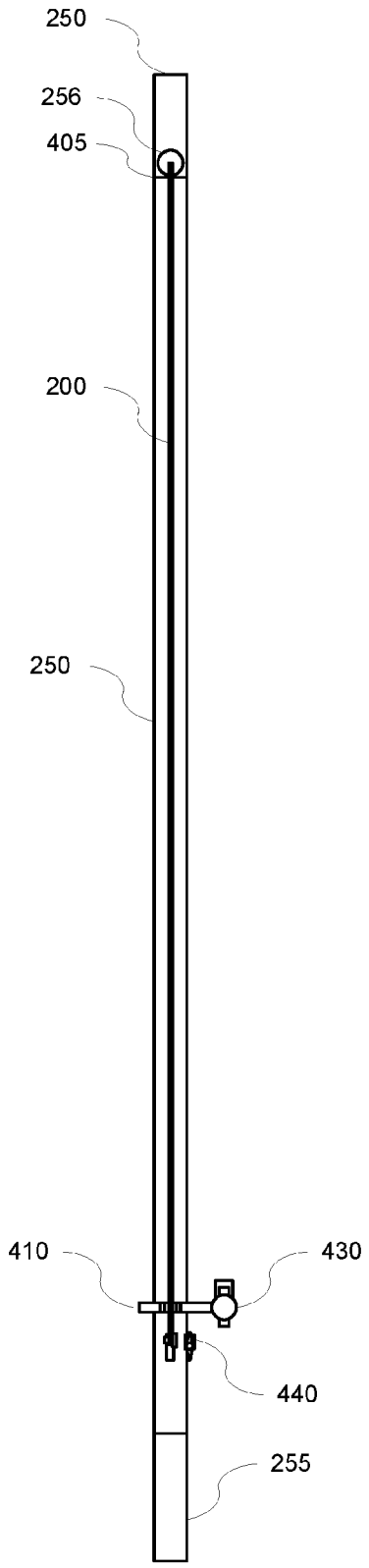

FIGS. 4A and 4B are diagrams illustrating an arco 250 in accordance with certain aspects of the present disclosure. The arco 250 may be about 220 cm in height (i.e., in a vertical orientation) and curve gracefully in a feminine shape substantially forming a bow portion 254. A bottom portion 255 of the arco 250 may be configured to be removably attached into the brackets 260 disposed on the perimeter of the platform 200. Each arco 250 may be strung across the bow portion 254 with one or more musical instrument strings 252, for example, but not limited to, sitar strings, (e.g., phosphorous bronze or other composition strings). The one or more musical instrument strings 252 may be attached to a back surface of the arco 250 at a top end of the arco 250 by a fastener (not shown) as known to those of ordinary skill in the art and may pass through a hole 256 from the back surface of the arco 250 to a fret 405 disposed on a front surface of the arco 250. A tube, for example, but not limited to a metal tube, may be disposed within the hole 256 and the musical instrument string 252 may pass through the tube.

Figure 5A:
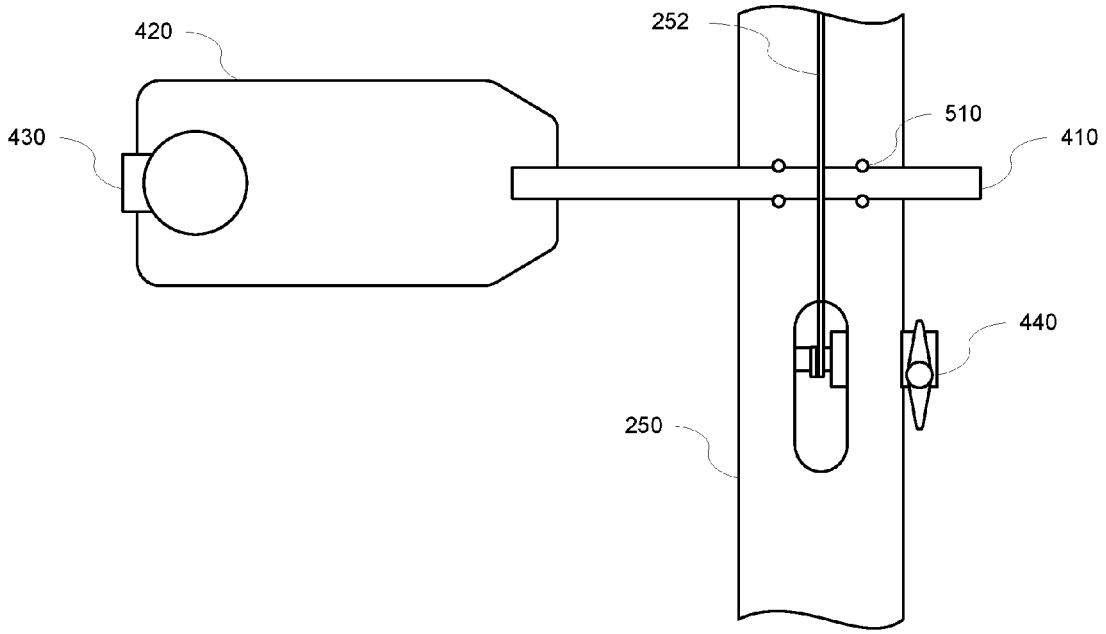
FIGS. 5A and 5B expanded views of an arco illustrating a bridge and tuning mechanism in accordance with certain aspects of the present disclosure.
Figure 5B:
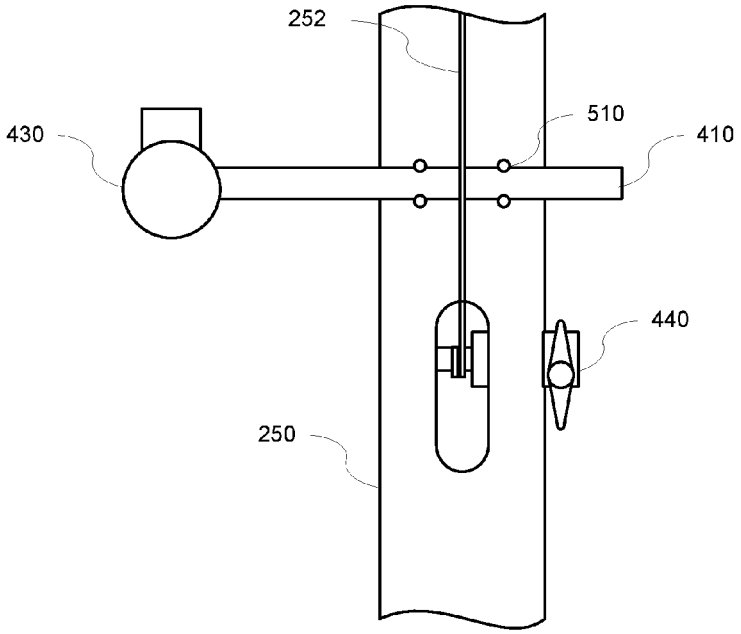

FIGS. 5A and 5B are expanded views of an arco 250 illustrating a bridge 410 and tuning mechanism 440 in accordance with certain aspects of the disclosure. The one or more musical instrument strings 252 may be drawn down across the bridge 410 disposed across a surface of the arco 250 near the end opposite to the end at which the one or more musical instrument strings 252 attach to the arco 250. The bridge 410 may be, for example, but not limited to, carbon fiber rod or other solid material (e.g., a metal or composite material). The bridge 410 may be positioned on the arco 250 between a plurality of positioning pins 510 attached to the arco 250. The one or more musical instrument strings 252 of the arcos 250 may be played with a bow (e.g., violin and/or cello bows), and/or plucked (e.g., with fingers and/or special hooks fitted to the jewelry of the performer's hands and feet). A copper pyramid may be disposed on a top of one or more of the arcos.

The acoustic sound produced by playing the one or more musical instrument strings 252 of each arco 250 may be amplified by capturing the sound with a microphone 430, for example, but not limited to, a contact microphone. In accordance with certain aspects of the disclosure, the microphone 430 may be fixed in direct or indirect contact with the bridge 410, for example, but not limited to, a carbon fiber rod, that may be fitted under the one or more musical instrument strings 252. In accordance with certain aspects of the disclosure, the microphone 430 may be fixed directly to the bridge 410 (e.g., the carbon fiber rod). In accordance with certain aspects of the disclosure, the microphone 430 may be fixed to a wooden element 420 coupled to the bridge 410.

Figure 6:
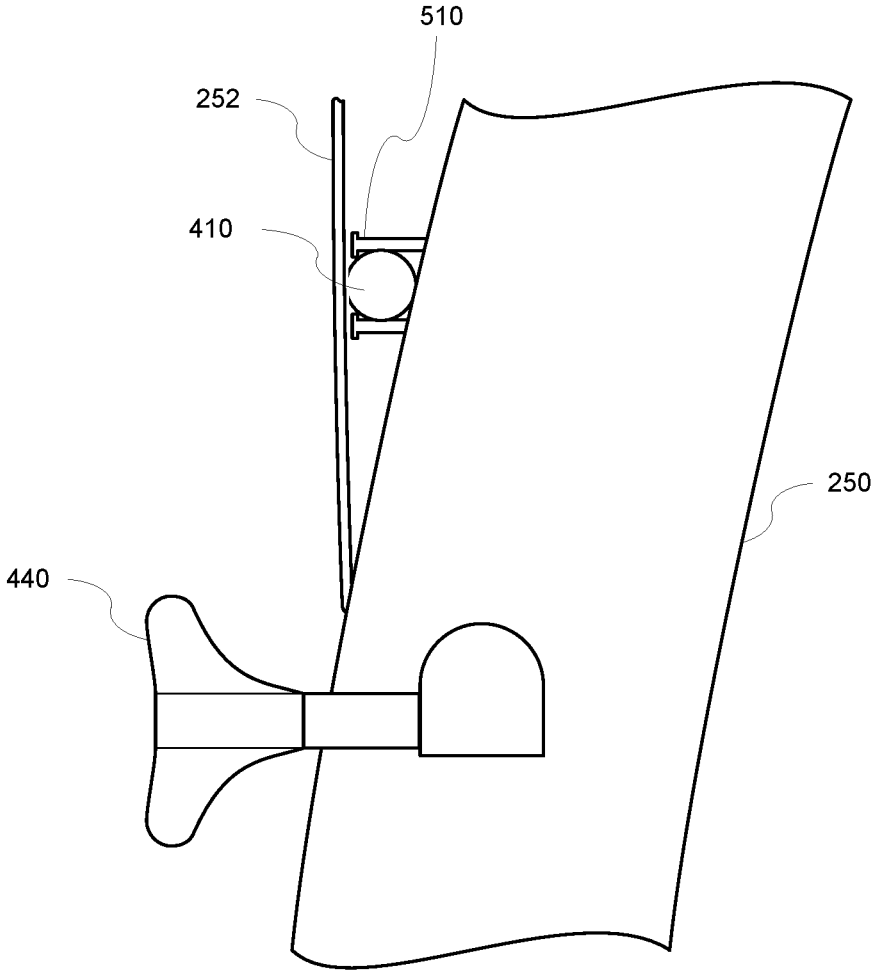
FIG. 6 is an expanded view of an arco illustrating the bridge and positioning pins in accordance with certain aspects of the present disclosure.

FIG. 6 is an expanded view of an arco 250 illustrating the bridge 410 and positioning pins 510 in accordance with certain aspects of the present disclosure. As illustrated in FIG. 6, positioning pins 510 are fixedly attached to the arco 250 in a manner to enable the bridge 410 to be positioned substantially perpendicular a vertical direction of the arco 250. The positioning pins 510 are set lower than a diameter of the bridge 410 such that only the bridge 410 and not the positioning pins 510 may contact the one or more musical instrument strings 252.

The one or more musical instrument strings 252 may be drawn down across the bridge 410 of the arco 250 and attached to a tuning mechanism 440 as known to those of ordinary skill in the art. The tuning mechanism 440 may be similar to, for example, but not limited to, a guitar string tuning mechanism or a bass guitar string tuning mechanism. Additionally, each of the one or more musical instrument strings 252 may be tuned to any of a plurality of pitches. For example, the one or more musical instrument strings 252 of each arco 250 may be tuned to within a minor third of the fundamental pitch. In addition, pitches needed for various musical compositions may be achieved by moving selected arcos 250 to brackets 260 at different positions around the perimeter of the platform 200.

Figure 7:
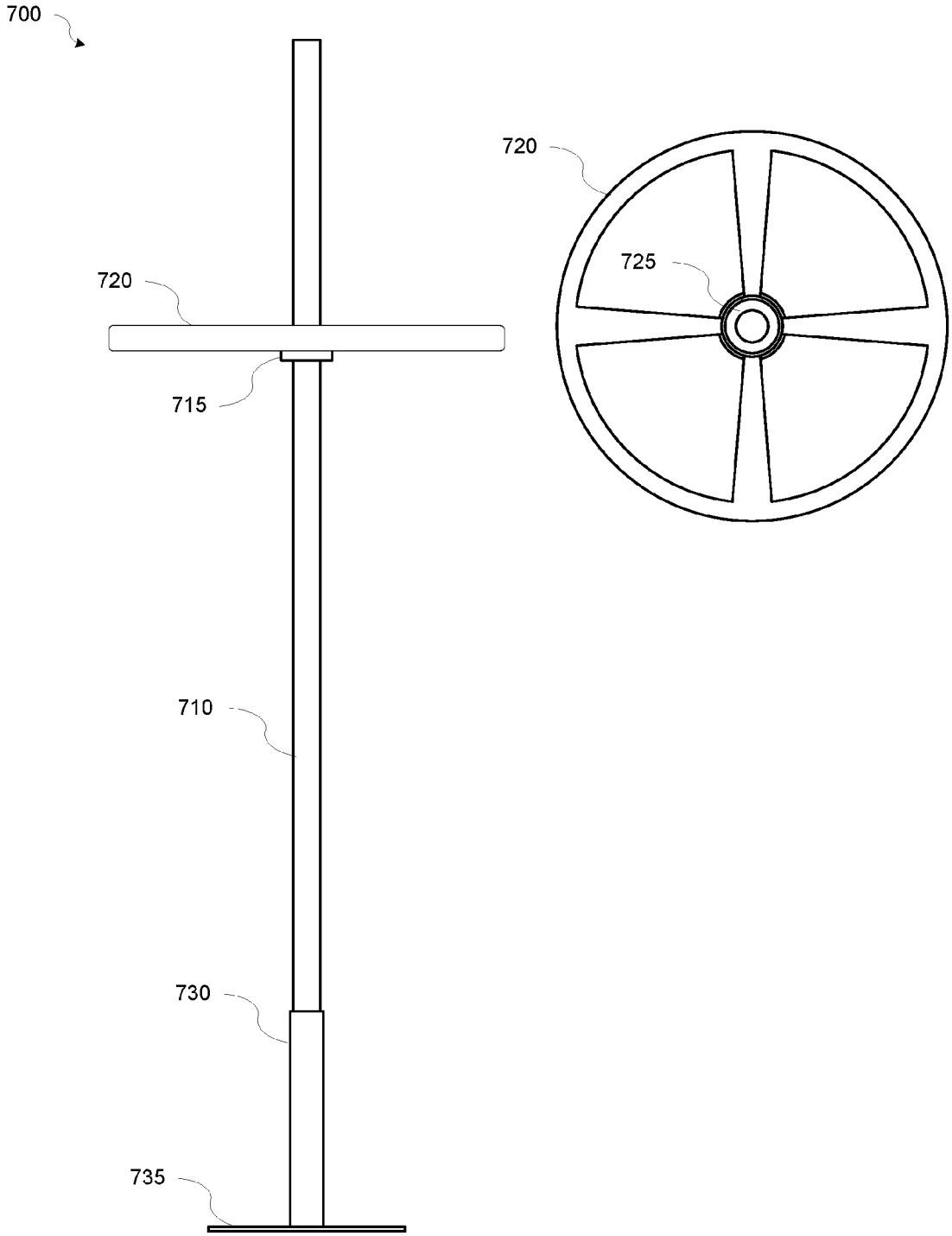
FIG. 7 is a view illustrating a central mast assembly in accordance with certain aspects of the present disclosure.

FIG. 7 is a view illustrating a central mast assembly 700 in accordance with certain aspects of the present disclosure. Referring to FIG. 7, the central mast assembly 700 may include a mast 710, a hand wheel 720, a lock ring 715, and a mast support 730. The mast 710 may be about 270 cm in height and may be removably attached to the mast support 730. The mast support 730, may be, for example, but not limited to, a tube having an inside diameter sized to accommodate and support the mast 710. The mast support 730 may further include a flange 735 configured to removably attach the central mast assembly 700 to the platform 200. The flange 735 may include a plurality of holes (not shown) through which fasteners, for example, bolts, screws, etc., may pass to attach the flange 735 to the platform. The central mast assembly 700 may be disposed substantially at the center of the platform 200.

The hand wheel 720 may be disposed on the mast 710 and the position of the hand wheel 720 may be adjustable along the height of the mast 710. The hand wheel 720 may be maintained at a desired height on the mast 710 by a lock ring 715. For example, the hand wheel 720 may be set at a height on the mast 710 to accommodate a position of a raised arm and grip of a user such that the height of the hand wheel 720 on the mast 710 is low enough for the user to grasp, yet high enough to clear the head of the user. The hand wheel 720 may rotate around the mast 710 on a bushing 725 made of copper or other suitable material, or on a bearing, for example, but not limited to, a ball bearing or roller bearing. Alternatively, the hand wheel 720 may not rotate around the mast 710.

In addition, the diameter of the hand wheel 720 may be selected to accommodate the user. For example, the diameter of the hand wheel 720 may be made large enough to provide the user with sufficient clearance around the centrally disposed keyboards/electronic sound processing equipment while enabling the user to hold on to the hand wheel 720. Thus, the music machine 100 may be adjusted to the size to a user. In accordance with certain aspects of the present disclosure, the hand wheel 720 may be about 60 cm in diameter. The central mast assembly 700 may facilitate the user moving around on the platform 200 of the music machine 100 quickly without losing balance. A crystal of quartz shaped in a pyramid may be disposed on top of the central mast assembly.

Figure 8:
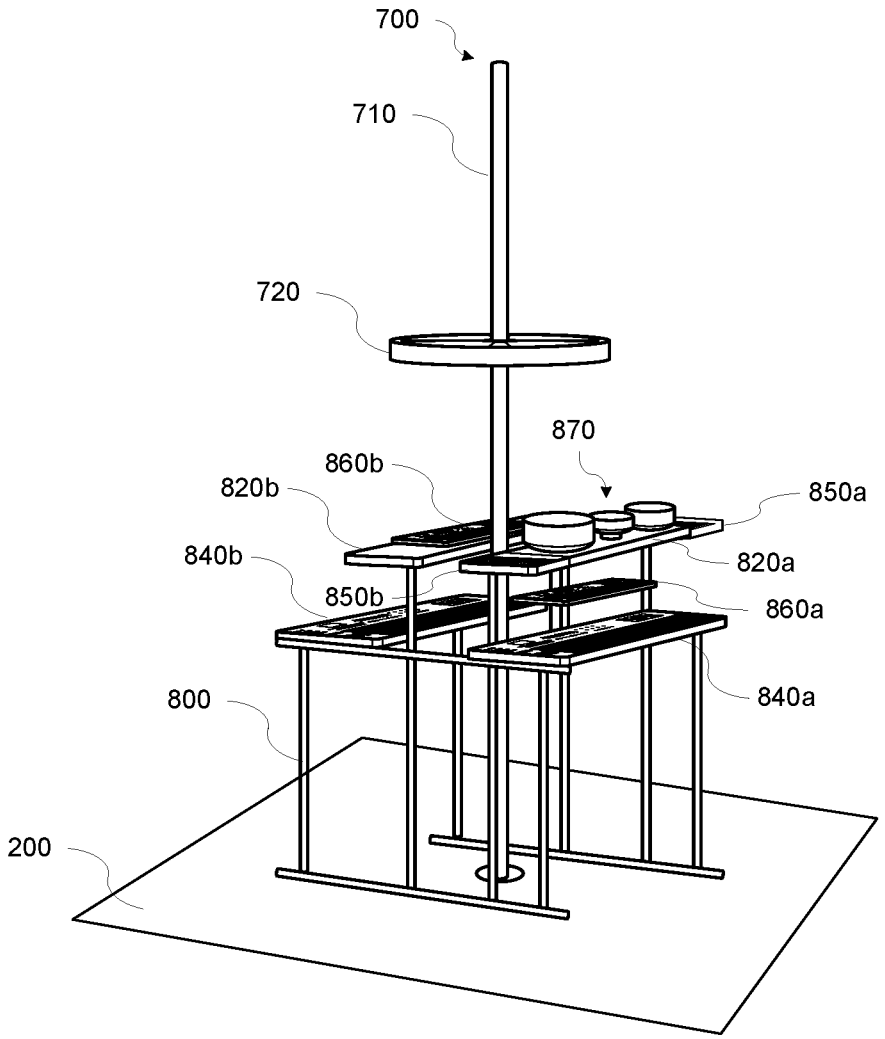
FIG. 8 is a diagram illustrating a rack assembly configured to accommodate a plurality of electronic instrumentation and shelves in accordance with certain aspects of the present disclosure.

FIG. 8 is a drawing illustrating a rack assembly 800 configured to accommodate a plurality of electronic instrumentation and shelves in accordance with certain aspects of the present disclosure. Referring to FIG. 8, the rack assembly 800, may be configured to support a plurality of shelves 820*a*, 820*b*, and various combinations of electronic instruments and/or sound processing equipment and/or and control equipment (e.g., electronic keyboards, loopers, amplifiers, audio effects equipment, instrument/sound effects synthesizer etc., computers, MIDI controllers, etc.) and/or acoustic elements, for example but not limited to, Crystal Singing Bowls and/or Tibetan Bowls 870. The rack assembly 800 may be substantially centrally disposed on the platform 200 and positioned around the central mast assembly 700.

In accordance with certain aspects of the present disclosure, the electronic instruments, sound processing equipment, and control equipment of the music machine may include two or more keyboards/MIDI controllers 840*a*, 840*b*, (e.g., M-Audio Axiom Pro-61 Controllers), two or more loopers 860*a*, 860*b*, (e.g., Boss RC 30 and/or RC 300) which may record the Crystal Singing Bowls and/or Tibetan Bowls 870 and a plurality of the one or more musical instrument strings 252 of the arcos 250, two or more key triggers 850*a*, 850*b*, (e.g., Akai model 25 MIDI Keyboard Controller) attached to a computer (e.g., a Mac Book Pro or other computer). An instrument/sound effects synthesizer, for example, but not limited to a Muse Receptor, connected between the keyboards/MIDI controllers and a digital sound file library may be provided. The digital sound file library may contain digital sound files that the keyboards/controllers 840*a*, 840*b*, may access via the instrument/sound effects synthesizer. The digital sound file library may be part of the instrument/sound effects synthesizer or may be a separate storage unit accessible by the interface and the keyboards/MIDI controllers.

A plurality of Tibetan Bowls 870 (e.g., three metal Tibetan Bowls) may be disposed on a shelf (e.g., the shelf 820*a*) on the rack assembly 800. Alternatively or additionally, one or more Crystal Singing Bowls (not shown) may be disposed on a shelf (e.g., the shelf 820*a* or 820*b*) on the rack assembly 800. The plurality of arcos 250, the plurality of Tibetan Bowls 870 and/or the one or more Crystal Singing Bowls may provide portions of acoustic elements of the music machine 100. The acoustic elements may produce audible sounds without intrinsic electronic amplification.

The sounds produced by the acoustic elements of the music machine 100 may subsequently be electronically amplified. For example, sound from an acoustic element may be received by a microphone or other electronic transducer and routed to an amplifier in a manner known to those of ordinary skill in the art. Other acoustic elements (not shown), for example, but not limited to, percussion instruments, may also be included and amplified by capturing their sounds with microphones. Alternatively, the acoustic elements of the music machine may be played without electronic amplification. For example, in a smaller venue, amplification of the acoustic elements may be unnecessary.

Figure 9:
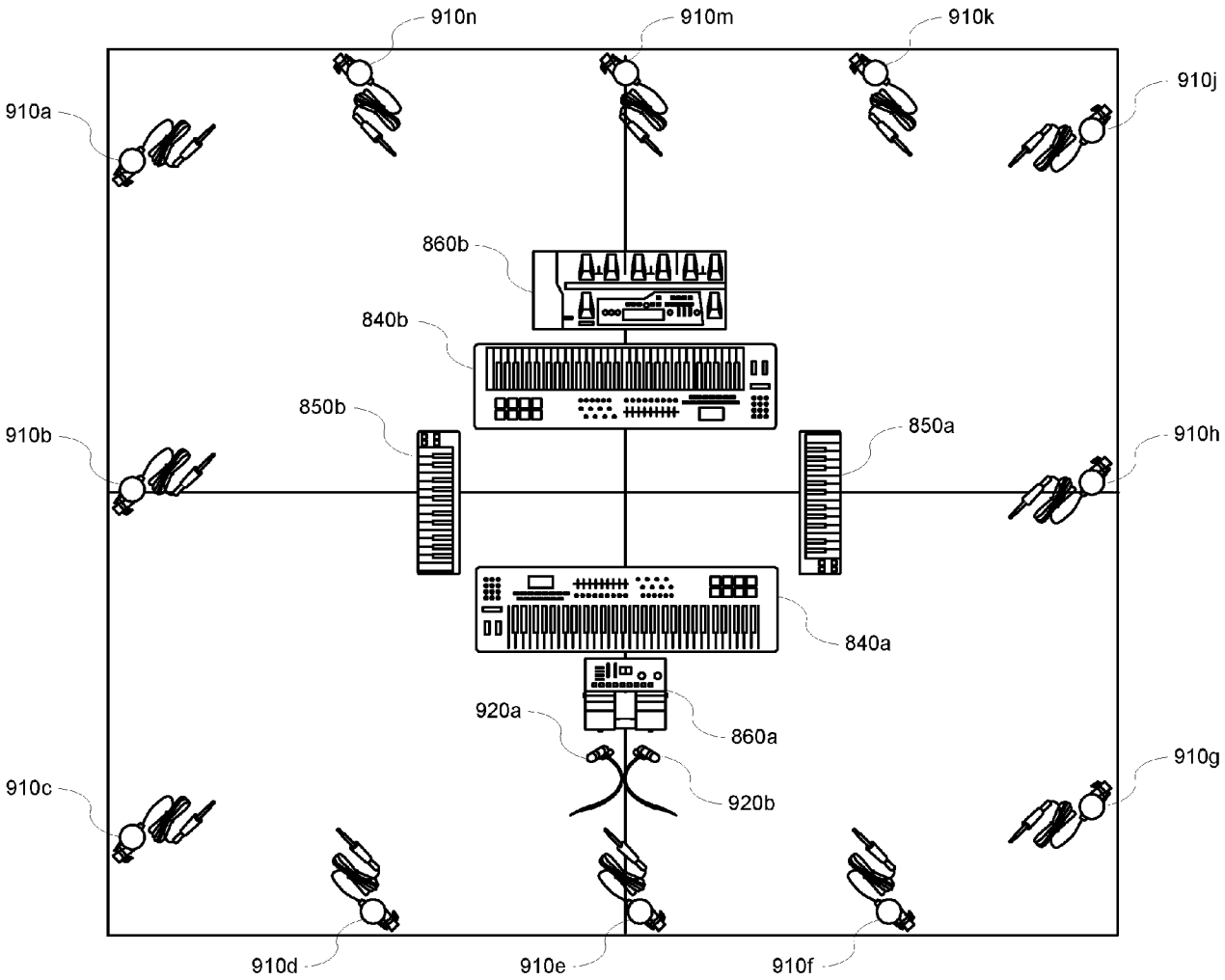
FIG. 9 is a diagram illustrating example placement of audio transducers in accordance with certain aspects of the present disclosure.

FIG. 9 is a diagram illustrating example placement of audio transducers and electronic instruments, sound processing equipment, and control equipment in accordance with certain aspects of the present disclosure. Referring to FIGS. 2-9, a plurality of audio transducers, for example, but not limited to, microphones, contact microphones, magnetic pickups, piezo-electric pickups, etc., may capture sounds from various portions of the instrument. For example, first audio transducers 910*a*-910*n* may capture sounds from the plurality of arcos 250 and second audio transducers 920*a*, 920*b* may capture sounds from the plurality of Tibetan Bowls 870 and/or the one or more Crystal Singing Bowls. The first audio transducers 910*a*-910*n* and the second audio transducers 920*a*, 920*b* may provide audio input signals to one or more audio mixer units and/or other control equipment. The first audio transducers 910*a*-910*n* and the second audio transducers 920*a*, 920*b* may be wired audio transducers, wireless audio transducers, or a combination of wired and wireless transducers.

Figure 10:
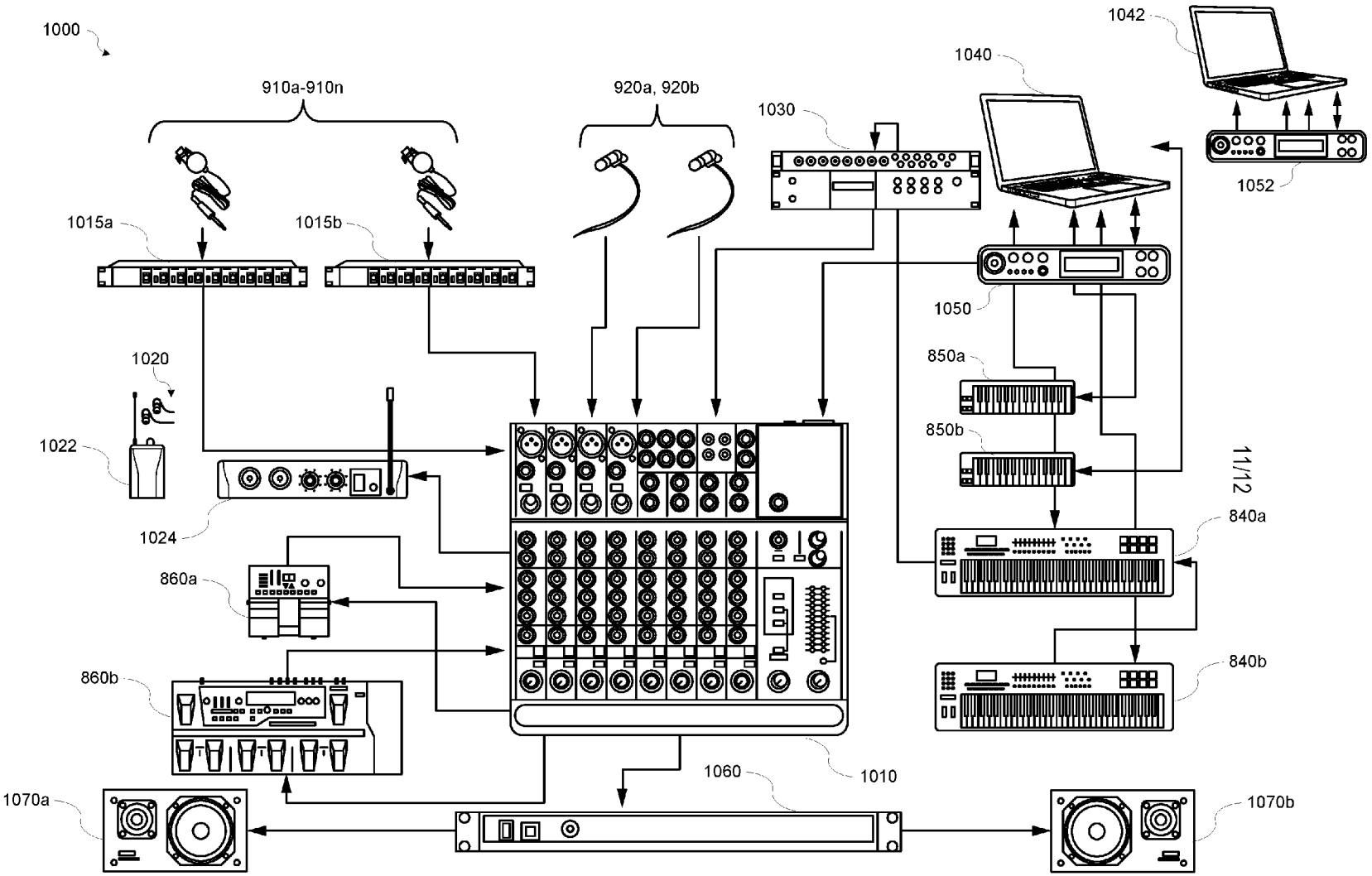
FIG. 10 is diagram illustrating representative interconnections between a representative configuration of electronic instruments, sound processing equipment, control equipment, audio transducers, and an audio mixer unit in accordance with certain aspects of the present disclosure.

FIG. 10 is a diagram illustrating representative interconnections 1000 between a representative configuration of electronic instruments, sound processing equipment, control equipment, audio transducers, and an audio mixer unit in accordance with certain aspects of the present disclosure. Referr4ing to FIG. 10, the electronic instruments, sound processing equipment, and control equipment 840*a*, 840*b*, 850*a*, 850*b*, 860*a*, 860*b*, may communicate with each other and/or one or more audio mixer units 1010 via various communication interfaces, for example, but not limited to, MIDI, USB, Bluetooth, Firewire (IEEE 1394), 802.11, RS232, Ethernet, etc., interfaces.

The first audio transducers 910*a*-910*n* may provide audio signals to one or more mixers 1015*a*, 1012*b*, and the mixers 1015*a*, 1015*b* may communicate with the one or more audio mixer units 1010. The second audio transducers 920*a*, 920*b* may provide audio input signals to the one or more audio mixer units 1010. The first audio transducers 910*a*-910*n* may additionally or alternatively provide signals to a trigger unit (not shown), for example, but not limited to, an Alesis sample rack, as triggers for electronic samples. In addition one or more wireless audio transducers 1020 may transmit audio signals via a wireless transmitter 1022 to a wireless receiver 1024 and the wireless receiver may communicate with the one or more audio mixer units 1010.

The two or more keyboards/MIDI controllers 840*a*, 840*b* may be interconnected and may communicate with a musical instrument synthesizer 1030. The two or more loopers 860*a*, 860*b* (i.e., sound processing equipment) and the musical instrument synthesizer 1030 may communicate with the one or more audio mixer units 1010. An audio interface unit 1050 may be configured to interface a computer 1040 with the two or more keyboards/MIDI controllers 840*a*, 840*b*, the two or more key triggers 850*a*, 850*b*, and the one or more audio mixer units 1010. A back-up computer 1042, a back-up audio interface 1052 for the back-up computer 1042, and an automatic switcher (not shown) may be provided so that in the event that the computer 1040 fails, the music machine 100 may automatically switch to the back-up computer 1042 without impacting a performance by the user.

The one or more audio mixer units 1010 may be, for example, but not limited to, a 30 channel audio mixer, and may be disposed remotely from the music machine platform 100. Signals from the electronic instruments, sound processing equipment, and amplified acoustic elements may be communicated to the one or more remotely disposed audio mixer units 1010. The one or more audio mixer units 1010 may be operated to adjust, for example, but not limited to, provide gain or attenuation, balancing, etc., sounds of the various portions of the music machine 100. An audio amplifier 1060 may receive an audio output signal from the one or more audio mixer units 1010 and may amplify the audio output signal for sound reproduction via sound reproduction equipment, for example, but not limited to, one or more speakers 1070*a*, 1070*b*. One of ordinary skill in the art will appreciate that the foregoing configuration is exemplary and that other configurations may be used without departing from the scope of the present disclosure.

Figure 11:
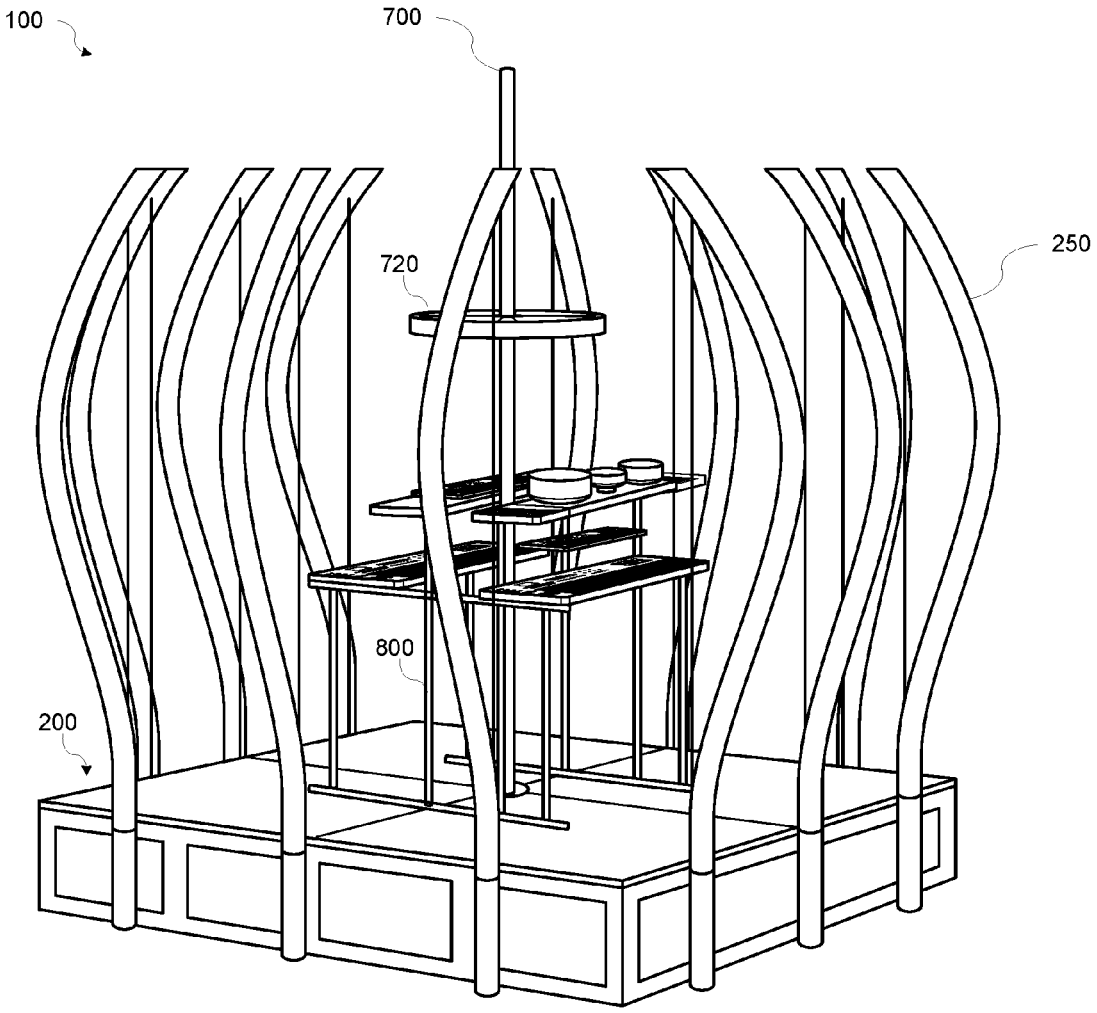
FIG. 11 is a diagram illustrating the placement of various elements of the music machine in accordance with certain aspects of the present disclosure.

FIG. 11 is a diagram illustrating the placement of various elements of the music machine 100 in accordance with certain aspects of the present disclosure. Referring to FIG. 11, the central mast assembly 700 may be disposed substantially at the center of the platform 200. The rack assembly 800 may be substantially centrally disposed on the platform 200 and positioned around the central mast assembly 700. The plurality of arcos 250 may be disposed around the perimeter of the platform 200.

The rack assembly 800, may be configured to support a plurality of shelves 820*a*, 820*b*, and various combinations of electronic instruments and/or sound processing equipment and/or and control equipment 840*a*, 840*b*, 850*a*, 850*b*, 860*a*, 860*b* (e.g., electronic keyboards, loopers, amplifiers, audio effects equipment, instrument/sound effects synthesizer etc., computers, MIDI controllers, etc.).

The hand wheel 720 may be disposed on the mast 710, for example, at a height to accommodate a position of a raised arm and grip of a user such that the height of the hand wheel 720 on the mast 710 is low enough for the performer to grasp, yet high enough to clear the head of the user. The central location of the central mast assembly 700 and rack assembly 800 may enable a user to rapidly move around the platform 200 to utilize the various instruments and electronic equipment by grasping the hand wheel 720 to maintain balance.

The accompanying claims and their equivalents are intended to cover such forms or modifications as would fall within the scope and spirit of the protection. For example, the example apparatuses, methods, and systems disclosed herein can be applied musical instruments combining a variety of acoustic and electronic instrumentation. The features and attributes of the specific example embodiments disclosed above may be combined in different ways to form additional embodiments, all of which fall within the scope of the present disclosure. Skilled artisans may implement the described functionality in varying ways for each particular application, but such implementation decisions should not be interpreted as causing a departure from the scope of the present invention.

In one or more exemplary aspects, the functions described may be implemented in hardware, software, firmware, or any combination thereof. If implemented in software, the functions may be stored as one or more instructions or code on a non-transitory computer-readable storage medium or non-transitory processor-readable storage medium. The steps of a method or algorithm disclosed herein may be embodied in processor-executable instructions that may reside on a non-transitory computer-readable or processor-readable storage medium. Non-transitory computer-readable or processor-readable storage media may be any storage media that may be accessed by a computer or a processor. By way of example but not limitation, such non-transitory computer-readable or processor-readable storage media may include RAM, ROM, EEPROM, FLASH memory, CD-ROM or other optical disk storage, magnetic disk storage or other magnetic storage devices, or any other medium that may be used to store desired program code in the form of instructions or data structures and that may be accessed by a computer. Disk and disc, as used herein, includes compact disc (CD), laser disc, optical disc, digital versatile disc (DVD), floppy disk, and blu-ray disc where disks usually reproduce data magnetically, while discs reproduce data optically with lasers. Combinations of the above are also included within the scope of non-transitory computer-readable and processor-readable media. Additionally, the operations of a method or algorithm may reside as one or any combination or set of codes and/or instructions on a non-transitory processor-readable storage medium and/or computer-readable storage medium, which may be incorporated into a computer program product.

Although the present disclosure provides certain example embodiments and applications, other embodiments that are apparent to those of ordinary skill in the art, including embodiments which do not provide all of the features and advantages set forth herein, are also within the scope of this disclosure. Accordingly, the scope of the present disclosure is intended to be defined only by reference to the appended claims.

What is claimed is:

1. A music machine, comprising:

a platform;

a plurality of arcos disposed around a perimeter of the platform, the plurality of arcos disposed in a substantially vertical orientation;

a central mast disposed substantially at a center of the platform; and a hand wheel disposed on the central mast, wherein each of the plurality of arcos is strung with a musical instrument string, and wherein each musical instrument string is tuned to produce a musical tone when caused to vibrate.

2. The music machine of claim 1, wherein the platform comprises a plurality of removably attached sub-platforms.

3. The music machine of claim 1, further comprising a plurality of electronic musical instruments and sound processing equipment and a rack assembly disposed substantially at a center of the platform and configured to support the plurality of electronic musical instruments and sound processing equipment.

4. The music machine of claim 3, wherein the plurality of electronic musical instruments and the sound processing equipment includes one or more keyboards/MIDI controllers, one or more loopers, and one or more musical instrument synthesizers.

5. The music machine of claim 1, wherein each of the arcos is removably attached around the perimeter of the platform.

6. The music machine of claim 1, wherein the hand wheel is rotatable around the central mast.

7. The music machine of claim 1, wherein the hand wheel is non-rotatable around the central mast.

8. The music machine of claim 1, wherein the musical tone produced by each arco is captured by a microphone in contact with a bridge which the musical instrument string is drawn against.

9. An apparatus for performing musical compositions, the apparatus comprising:

a computer;

a plurality of electronic musical instruments disposed on a platform;

an audio interface configured to provide communication between the plurality of electronic musical instruments and the computer configured to control the plurality of electronic musical instruments;

a plurality of acoustic musical instruments disposed around a perimeter of the platform;

wherein the platform provides a surface for a user to stand and move around between the plurality of electronic musical instruments and the plurality of acoustic musical instruments disposed around the perimeter of the platform.

10. The apparatus of claim 9, wherein each of the plurality of acoustic musical instruments disposed around the perimeter of the platform comprises a plurality arcos each having a bow-shaped portion and a musical instrument string strung across the bow-shaped portion, each musical instrument string tuned to produce a musical tone when caused to vibrate.

11. The apparatus of claim 9, wherein each of the plurality of acoustic musical instruments disposed around the perimeter of the platform are reconfigurable to different positions around the perimeter of the platform.

12. The apparatus of claim 9, wherein the plurality of electronic musical instruments is disposed substantially at a center portion of the platform forming a space between the plurality of electronic musical instruments and the plurality of acoustic musical instruments disposed around the perimeter of the platform for the user to access and operate the plurality of electronic musical instruments and the plurality of acoustic musical instruments.

13. The apparatus of claim 12, further comprising a hand wheel disposed on a mast, the mast disposed substantially at a center of the platform, wherein a position of the hand wheel is adjustable in a vertical direction on the mast providing a hand hold for the user.

14. The apparatus of claim 13, wherein the hand wheel is rotatably attached to the mast to assist the user in moving around the space between the plurality of electronic musical instruments and the plurality of acoustic musical instruments.

15. An acoustic-electronic musical instrument, comprising:

a plurality of arcos each having a bow-shaped portion and a musical instrument string strung across the bow-shaped portion, each musical instrument string tuned to produce a musical tone when caused to vibrate;

a plurality of electronic musical instruments and sound processing equipment communicatively coupled to a computer with an audio interface unit;

a plurality of audio transducers configured to capture musical tones produced the plurality of arcos; and an audio mixer unit configured to input audio signals from the plurality of electronic musical instruments, the sound processing equipment, and the audio transducers, adjust the audio signals, and output the audio signals to sound reproduction equipment.

16. The acoustic-electronic musical instrument of claim 15, wherein the plurality of electronic musical instruments and the sound processing equipment are disposed on a platform and the plurality of arcos are disposed around a perimeter of the platform, and wherein the audio mixer unit is disposed remotely from the platform.

17. The acoustic-electronic musical instrument of claim 16, wherein the platform comprises a plurality of removably attached sub-platforms.

18. The acoustic-electronic musical instrument of claim 16, wherein the arcos are removably attached around the perimeter of the platform are reconfigurable to different positions around the perimeter of the platform.

19. The acoustic-electronic musical instrument of claim 16, further comprising a mast assembly having a rotatable hand wheel disposed on a mast, the mast assembly disposed substantially at a center of the platform.

* * * * *